US005839205A

United States Patent [19]

Hung

[11] Patent Number: 5,839,205

[45] Date of Patent: Nov. 24, 1998

[54] ELECTRIC FAN USING MULTIPLE FAN BLADES TO RAISE AIR OUTPUT PRESSURE

[76] Inventor: Fred L. Hung, 2F, No. 101, Sec. 2, Chung Ching Rd., Taoyuan City, Taoyuan Hsien, Taiwan

[21] Appl. No.: 925,185

[22] Filed: Sep. 8, 1997

[51] Int. Cl.[6] ..... A45D 24/10

[52] U.S. Cl. ..... 34/97; 417/423.5

[58] Field of Search ..... 34/97, 98; 417/354, 417/408, 423.5; 415/220, 222; 392/380

[56] References Cited

U.S. PATENT DOCUMENTS 4,482,302 11/1984 Grignon ..... 417/354
5,341,578 8/1994 Anderson ..... 34/97
5,392,528 2/1995 McDougall ..... 34/97

*Primary Examiner*—Henry A. Bennett
*Assistant Examiner*—Steve Gravini
*Attorney, Agent, or Firm*—Bacon & Thomas

[57] ABSTRACT

An electric fan including a stepped cylindrical housing covered with an air output cap, a motor fastened to a mounting ring inside the housing, a locating ring mounted inside the housing and holding an axle bearing, an axle bearing revolvably supported on the axle bearing and turned with the motor shaft of the motor, and three fan blade wheel assemblies mounted on the axle inside the housing, each fan blade wheel assembly having a fan blade wheel fixedly mounted around the axle and a hood with a center hole fixedly mounted inside the housing and covered over the fan blade wheel.

1 Claim, 5 Drawing Sheets

ELECTRIC FAN USING MULTIPLE FAN BLADES TO RAISE AIR OUTPUT PRESSURE

BACKGROUND OF THE INVENTION (a) Field of the Invention

The present invention relates to electric fans, and more particularly to such an electric fan which comprises a plurality of fan blade assemblies axially arranged in a stack and driven to induce high pressure air.

(b) Description of the Prior Art

Regular hair dryers are commonly comprised of a motor, and a fan blade wheel coupled to the motor shaft of the motor. When the motor is started, the fan blade wheel is turned to induce currents of air. Because conventional hair dryers have only one fan blade wheel, they cannot induce better high pressure air.

SUMMARY OF THE INVENTION

It is the main object of the present invention to provide an electric fan which simultaneously turns a plurality of fan blade wheels to induce high pressure air when started. According to the preferred embodiment of the present invention, the electric fan comprises a stepped cylindrical housing covered with an air output cap, a motor fastened to a mounting ring inside the housing, a locating ring mounted inside the housing and holding an axle bearing, an axle bearing revolvably supported on the axle bearing and turned with the motor shaft of the motor, and three fan blade wheel assemblies mounted on the axle inside the housing, wherein each fan blade wheel assembly comprises a fan blade wheel fixedly mounted around the axle, and a hood with a center hole fixedly mounted inside the housing and covered over the fan blade wheel.

DETAILED DESCRIPTION OF THE PREFERRED EMBODIMENT

Figure 1:
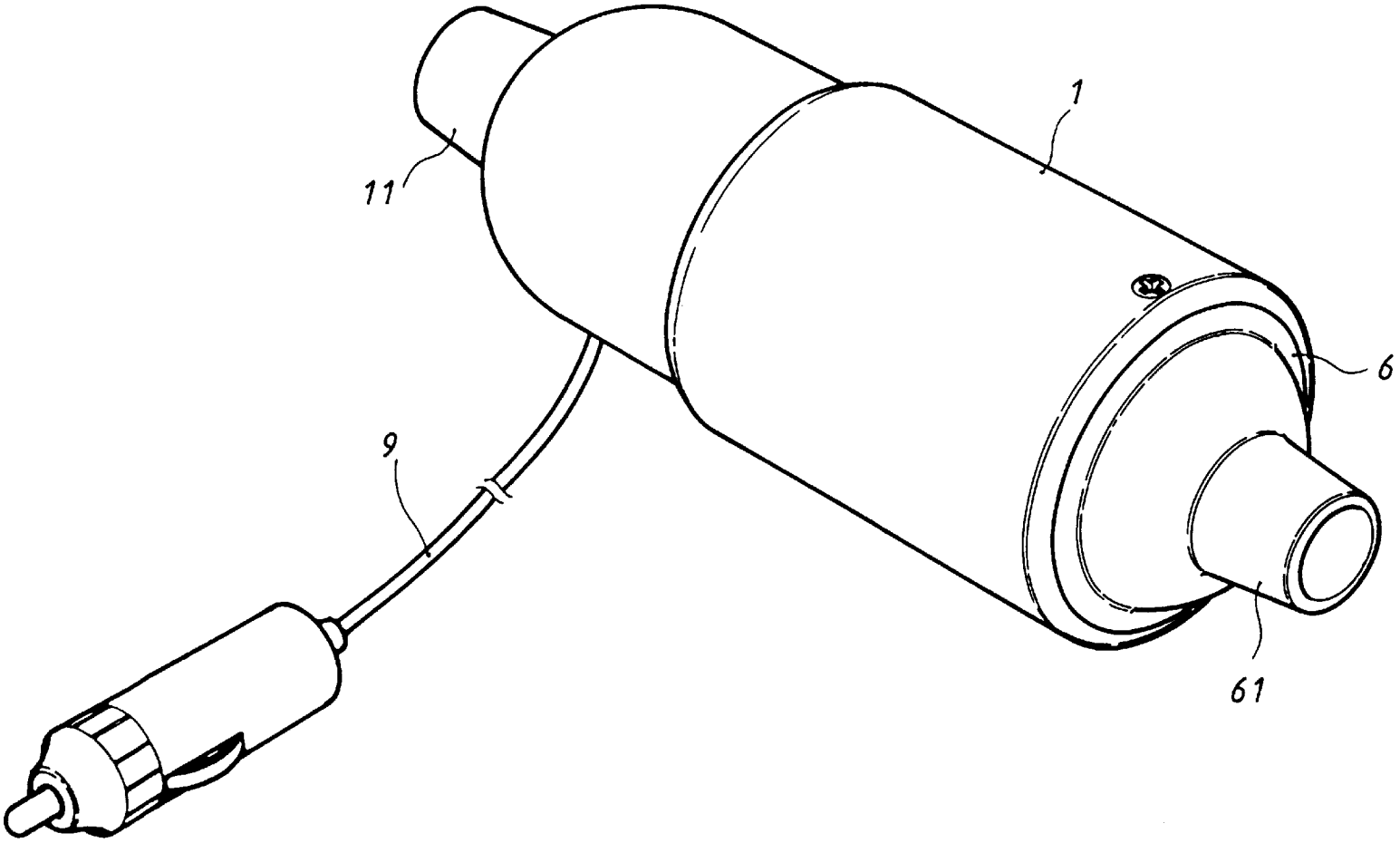
FIG. 1 is an elevational view of an electric fan according to the present invention.
Figure 2:
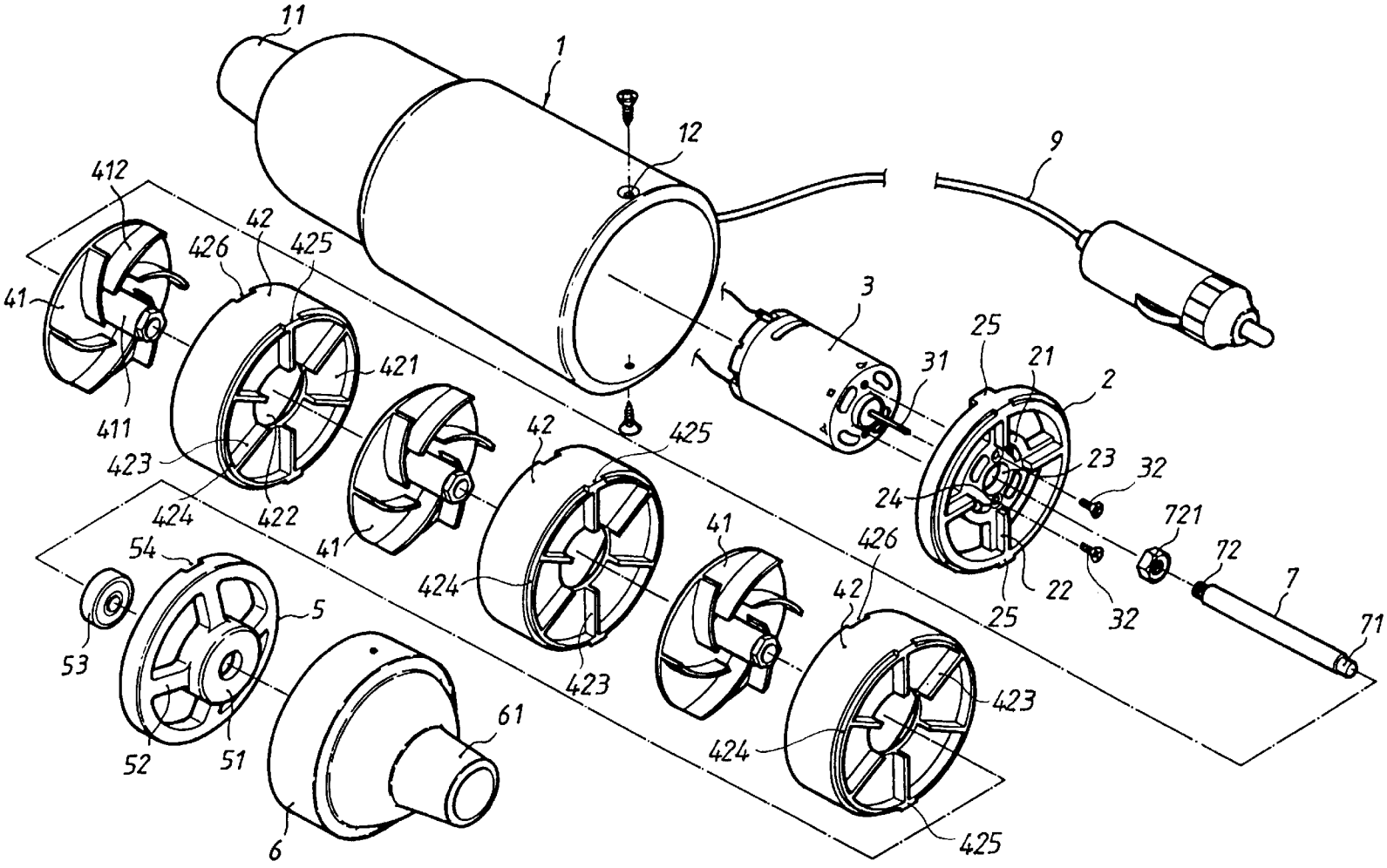
FIG. 2 is an exploded view of the electric fan shown in FIG. 1.

Referring to FIGS. 1 and 2, an electric fan in accordance with the present invention is generally comprised of a housing 1, a mounting ring 2, a motor 3, three fan blade wheel assemblies 4, a locating ring 5, an air output cap 6, and an axle 7.

The housing 1 is a cylindrical shell having a reduced tubular rear end 11 and two mounting holes 12 bilaterally disposed at its expanded front end. The mounting ring 2 comprises an annular rib 21 at the center, a plurality of radial ribs 22 extended from the periphery of the annular rib 21, a center hole 23 defined within the annular rib 21, two axial mounting holes 24 bilaterally disposed at the annular rib 21, and two pairs of projecting portions 25 axially and bilaterally raised from the periphery at its front and bottom sides. The motor 3 is fixedly fastened to the mounting holes 24 of the mounting ring 2, having a motor shaft 31 inserted through the center hole 23 of the mounting ring 2. Each fan blade wheel assembly 3 is comprised of a fan blade wheel 41 and a hood 42 covered on the fan blade wheel 41. The fan blade wheel 41 comprises a hollow center shaft 411, and a plurality of curved blades 412 radially extended from the hollow center shaft 411. The hood 42 comprises an inside partition wall 421, a center hole 422 at the center of the inside partition wall 421, a plurality of reinforcing ribs 423 raised from the inside partition wall 421 and radially extended from the center hole 422, an upward annular flange 424 axially raised from its front side, two projecting portions 425 symmetrically raised from the upward annular flange 424 at two opposite sides, and two bottom notches 426 bilaterally disposed at its back side corresponding to the projecting portions 425. The locating ring 5 comprises a ring cap 51 at the center, a plurality of radial ribs 52 extended from the ring cap 51, an axle bearing 53 mounted within the ring cap 51, and two bottom notches 54 bilaterally disposed at its bottom side. The air output cap 6 comprises a reduced tubular front end 61 through which induced air passes. The axle 7 is inserted through the fan blade wheel assemblies 4, having two opposite ends respectively terminating in a front extension rod 71 and a threaded tube 72. The threaded tube 72 of the axle 7 is fastened to the motor shaft 31 of the motor 3, and screwed up with a nut 721.

Figure 3:
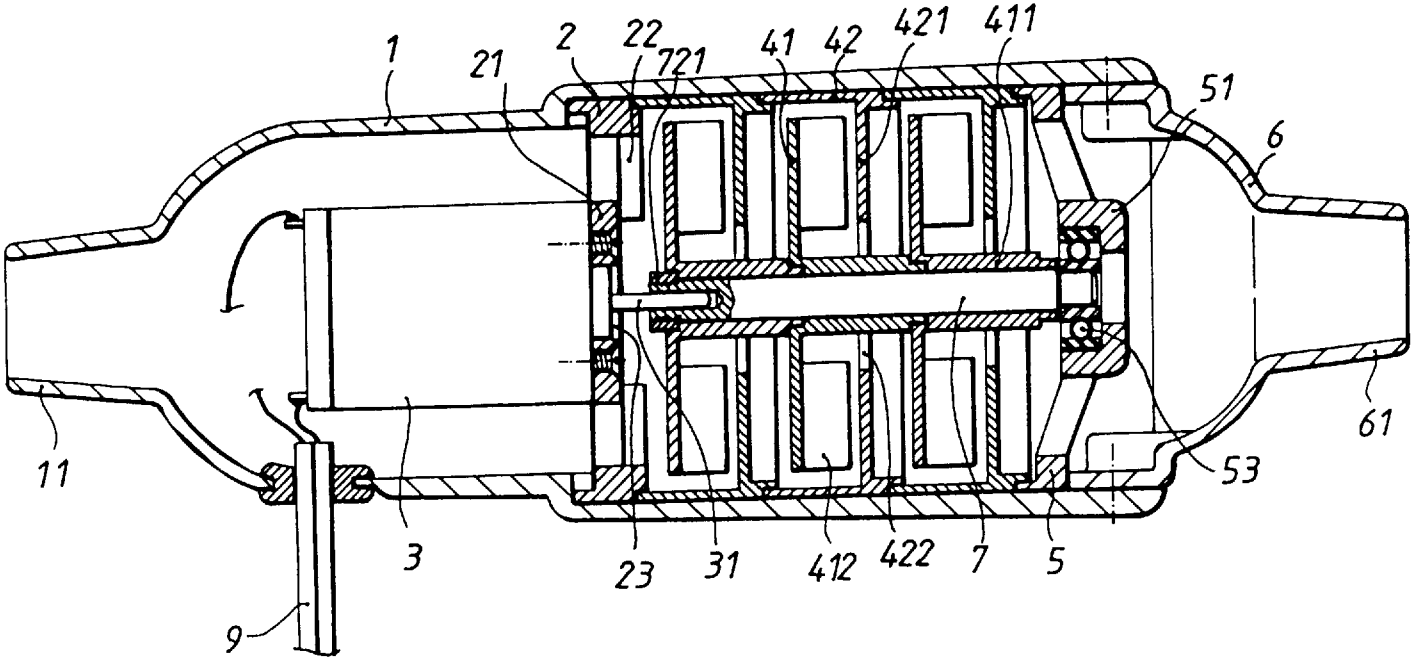
FIG. 3 is a longitudinal view in section of the electric fan shown in FIG. 1.

The assembly process of the electric fan is outlined hereinafter with referenced to FIGS. 2 and 3. The motor shaft 31 of the motor 3 is inserted through the center hole 23 of the mounting ring 2, then the motor 3 is fixedly fastened to the mounting holes 24 of the mounting ring 2 by screws 32, then the nut 721 is threaded onto the threaded tube 72 of the axle 7, and then the threaded tube 72 of the axle 7 is fixedly fastened to the motor shaft 31 of the motor 3, and then the axle 7 is inserted through the center holes 422 and hollow center shafts 411 of the fan blade wheel assemblies 4, and then the fan blade wheel assemblies 4 are closely attached to each other and arranged in a stack by forcing the projecting portions 425 of one hood 42 into engagement with the bottom notches 426 of another, and then the fan blade wheel assemblies 4 are closely attached to the mounting ring 2 by forcing the bottom notches 426 of the hood 42 of one fan blade wheel assembly 4 into engagement with the two projecting portions 25 at the front side of the mounting ring 2 (the two projecting portions 25 at the rear side of the mounting ring 2 are forced into engagement with a grooved inside wall of the housing 1), and then the front extension rod 72 of the axle 7 is inserted into the axle bearing 53 in the ring cap 51 of the locating ring 5, and then the locating ring 5 is attached to the fan blade wheel assemblies 4 by forcing its bottom notches 54 into engagement with the projecting portions 425 of the hood 42 of one fan blade wheel assembly 4, and then the air output cap 6 is covered on the expanded front end of the housing 1 is fixedly fastened to its mounting holes 12 by screws.

Figure 4:
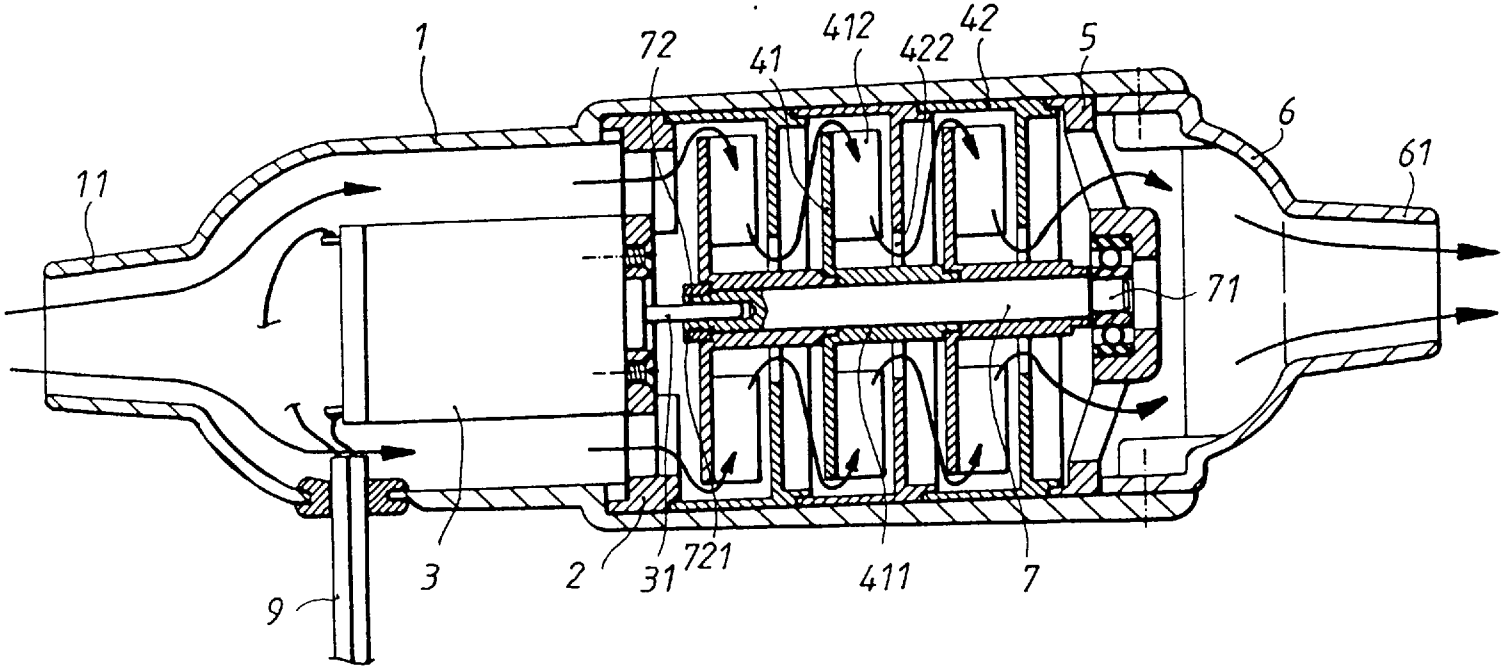
FIG. 4 is a sectional view of the present invention, showing the motor started, currents of air driven out of the air output cap.

Referring to FIG. 4, when the motor 3 is started, the fan blade wheels 41 are turned relative to the hoods 42, outside air is drawn through the reduced tubular rear end 11 into the housing 1, and then forced by the curved blades 412 of the fan blade wheels 41 to pass through the center holes 422 of the hoods 42 in proper order and then to pass out of the housing 1 through the reduced tubular front end 61 of the air output cap 6.

Referring to FIGS. 1 and 2 again, an electrical cable 9 may be connected to the motor 3 for obtaining car battery power supply from the electric socket for cigarette lighter of a motor vehicle.

Figure 5:
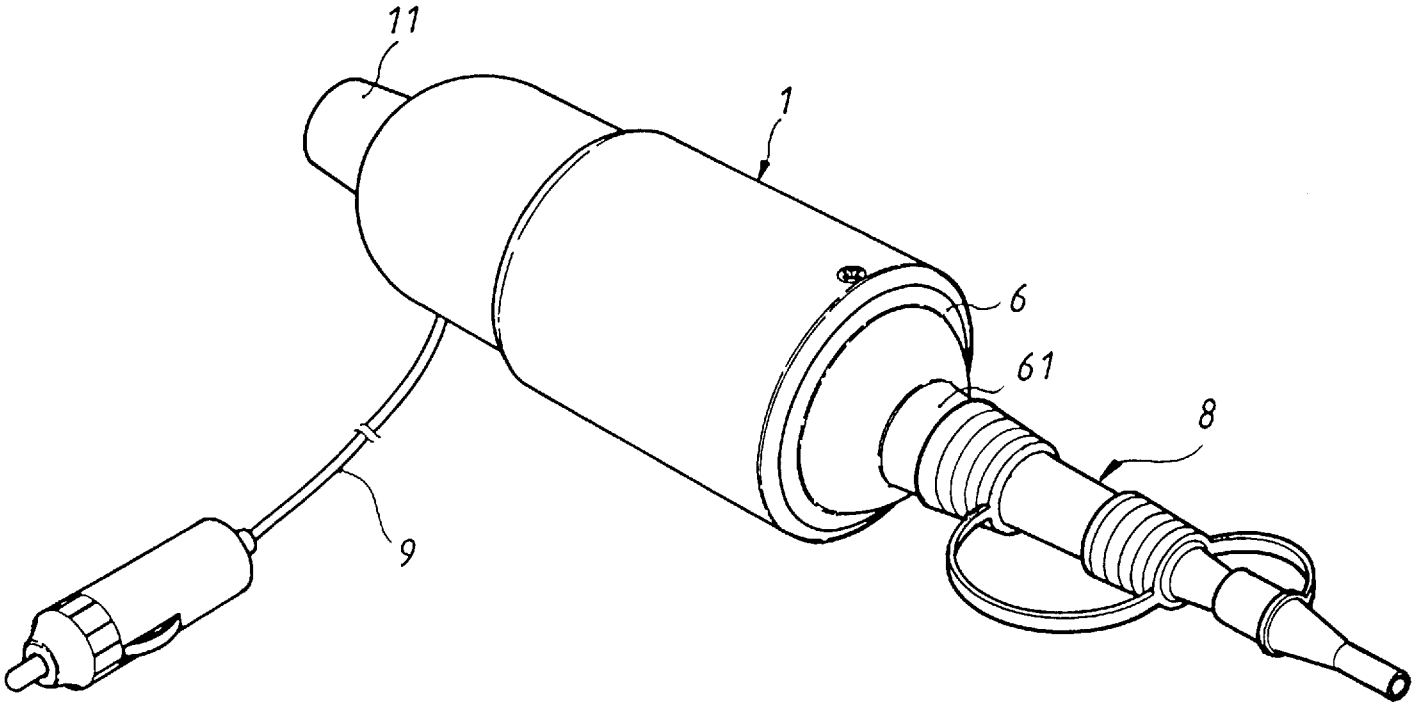
FIG. 5 shows a nozzle tube attached to the air output cap.

Referring to FIG. 5, a nozzle tube 8 may be attached to the air output cap 6 for guiding pressured output air from the electric fan to an inflatable object (life buoy, rubber boat, etc.).

It is to be understood that the drawings are designed for purposes of illustration only, and are not intended as a definition of the limits and scope of the invention disclosed.

What the invention claimed is:

1. An electric fan comprising:

a cylindrical housing having a reduced tubular rear end for air input and two mounting holes bilaterally disposed at an expanded front end thereof;

an air output cap covered on the expanded front end of said cylindrical housing and fixedly fastened to the mounting holes of said cylindrical housing by screws;

a mounting ring mounted inside said cylindrical housing, said mounting ring comprising an annular rib at the center, a plurality of radial ribs extended from the periphery of its annular rib, a center hole defined within its annular rib, two axial mounting holes bilaterally disposed at its annular rib, a rear pair of projecting portions axially and bilaterally raised from the periphery of a rear side thereof and fastened to a grooved inside wall of said cylindrical housing and a front pair of projecting portions axially and bilaterally raised from the periphery of a front side thereof;

a motor disposed inside said cylindrical housing and fixedly fastened to the mounting holes of said mounting ring by screws, said motor having a motor shaft inserted through the center hole of said mounting ring;

a locating ring mounted inside said cylindrical housing adjacent said air output cap, said locating ring comprising a ring cap at the center, a plurality of radial ribs extended from its ring cap, an axle bearing mounted within its ring cap, and two bottom notches bilaterally disposed at a bottom side thereof;

an axle having a front end supported on said axle bearing of said locating ring and a rear end fixedly connected to the motor shaft of said motor; and a plurality of fan blade wheel assemblies mounted on said axle inside said cylindrical housing and arranged in a stack and turned to causes currents of air toward the reduced tubular front end of said air output cap, each of said fan blade wheel assemblies comprised of a fan blade wheel and a hood covered on said fan blade wheel, said fan blade wheel comprising a hollow center shaft fixedly fastened to said axle, and a plurality of curved blades radially extended from said hollow center shaft, said hood comprising an inside partition wall, a center hole at the center of said inside partition wall through which the hollow center shaft of said fan blade wheel passes, a plurality of reinforcing ribs raised from said inside partition wall, an upward annular flange axially raised from a front side thereof, two projecting portions symmetrically raised from said upward annular flange at two opposite sides, and two bottom notches bilaterally disposed at a rear side thereof, the bottom notches of the hood of one fan blade wheel assembly at a bottom side being forced into engagement with the front pair of projecting portions of said mounting ring, the projecting portions of the hood of one fan blade wheel at behind being forced into engagement with the bottom notches of the hood of one fan blade wheel at a front side.

* * * * *